US008766123B2

(12) United States Patent
Hu et al.

(10) Patent No.: US 8,766,123 B2
(45) Date of Patent: Jul. 1, 2014

(54) KEY DEVICE AND ELECTRONIC APPARATUS CONTAINING THE KEY DEVICE

(75) Inventors: Yangjian Hu, Beijing (CN); Yikai Zhang, Beijing (CN); Xiyong Tian, Beijing (CN)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 153 days.

(21) Appl. No.: 13/430,838

(22) Filed: Mar. 27, 2012

(65) Prior Publication Data

US 2012/0261240 A1 Oct. 18, 2012

(30) Foreign Application Priority Data

Apr. 15, 2011 (CN) ..... 2011 1 0095261

(51) Int. Cl.
*H01H 13/70* (2006.01)
*H01H 3/42* (2006.01)

(52) U.S. Cl.
USPC ..... 200/345; 200/533

(58) Field of Classification Search
USPC ..... 200/345, 341, 292, 533, 245, 542, 538, 200/574, 293, 520, 51.09, 51.1, 51.11, 200/51.12, 51.16, 51.17, 453, 412, 417, 200/510, 43.18, 314; 439/188
See application file for complete search history.

(56) References Cited

U.S. PATENT DOCUMENTS

| | | | | |
|---|---|---|---|---|
| 4,153,829 | A * | 5/1979 | Murata | 200/533 |
| 4,920,245 | A | 4/1990 | Takano et al. | |
| 4,935,591 | A * | 6/1990 | Kaneko | 200/293 |
| 5,124,514 | A * | 6/1992 | Chen | 200/533 |
| 6,738,475 | B1 * | 5/2004 | Lieber | 379/428.01 |

FOREIGN PATENT DOCUMENTS

| | | |
|---|---|---|
| DE | 36 03 680 A1 | 8/1987 |
| DE | 297 16 198 U1 | 10/1997 |

OTHER PUBLICATIONS

Extended European Search Report, corresponding to EP 12 002 313.0, dated Aug. 9, 2012.

* cited by examiner

*Primary Examiner* — Renee Luebke
*Assistant Examiner* — Harshad Patel
(74) *Attorney, Agent, or Firm* — Renner, Otto, Boisselle & Sklar, LLP.

(57) ABSTRACT

A key device and electronic apparatus containing the key device. The key device comprises a housing and key structure, a hollow accommodating space in the housing. The key structure comprising: a key body, at least part of the key body being accommodated in the hollow accommodating space; a lateral contacting structure within the hollow accommodating space and comprising a contacting portion provided at the outer side of the key body, and when being pressed, the lateral contacting structure being squeezed by the key body, so that the contacting portion is in contact with a flexible printed circuit board; and a flexible printed circuit board within the hollow accommodating space at the outer side of the contacting portion for inducting the lateral contact of the contacting portion. Since lateral contact is made with the flexible printed circuit board, the key may be transparent when the key body is transparent.

15 Claims, 4 Drawing Sheets

Related Art

KEY DEVICE AND ELECTRONIC APPARATUS CONTAINING THE KEY DEVICE

TECHNICAL FIELD

The present invention relates to a key of an electronic apparatus, and in particular to a key device and electronic apparatus containing the key device.

BACKGROUND ART

Currently, in people's daily lives and works, various electronic apparatuses are frequently used, such as a telephone, a computer, a personal computer, a notebook computer, a personal digital assistant (PDA), a mobile telephone (mobile phone), etc. Most of these electronic apparatuses are provided with keys.

FIG. 1 illustrates the structure of a key of a typical electronic apparatus. As shown in FIG. 1, the structure of a key of a typical electronic apparatus contains a key body, the key body having a key top 11 and a plunger 12, and by pressing the key top 11, the plunger 12 generates a force effect on a corresponding key sensing (sometimes referred to as inducting) portion (a normal dome as shown in FIG. 1) on the circuit board of the electronic apparatus, thereby providing key information.

As the use of electronic apparatuses widens, the demands of people regarding appearance of electronic apparatuses increase, and they desire electronic apparatuses having transparent keys. However, since the dome 13 of the key structure of the electronic apparatus shown in FIG. 1 is not opaque, the effect that the keys are completely transparent cannot be realized, even though the key top 11 and the plunger 12 are made of a transparent material. For example, looking downwards from the key top 11, the dome 13 of the electronic apparatus can still be seen.

Therefore, how to realize the complete transparency of the key of an electronic apparatus is under study in the art.

SUMMARY OF THE INVENTION

The present invention is provided in view of the above problem in prior art.

The present invention is addressed to provide a key device and electronic apparatus containing the key device, so as to realize the complete transparency of the key of an electronic apparatus when the key body in a key device is made of a transparent material.

According to a first aspect of the present invention, there is provided a key device, comprising a housing and a key structure, a hollow accommodating space being provided in the housing, and the key structure comprising:

a key body, at least part of the key body being accommodated in the hollow accommodating space;

a lateral contacting structure positioned within the hollow accommodating space and comprising a contacting portion, the contacting portion being provided at the outer side of the key body, and when being pressed, the lateral contacting structure being squeezed by the key body, so that the contacting portion is in contact with a flexible printed circuit board; and a flexible printed circuit board positioned within the hollow accommodating space and provided at the outer side of the contacting portion for sensing the lateral contact of the contacting portion.

According to a second aspect of the present invention, there is provided a key device as described in the first aspect, wherein the lateral contacting structure further comprises a fixed portion and a squeezing portion, with the contacting portion being provided between the fixed portion and the squeezing portion; the fixed portion being fixedly provided on the inner surface of the hollow accommodating space; the contacting portion being spaced apart from the flexible printed circuit board at a certain distance when the key body is in a loosened state, and being in contact with the flexible printed circuit board when the key body is in a pressed state; the squeezing portion supporting the key body when the key body is in a loosened state, and moving towards the flexible printed circuit board under the squeeze of the squeezing portion when the key body is in a pressed state, and directing the contacting portion to be in contact with the flexible printed circuit board.

According to a third aspect of the present invention, there is provided a key device as described in the second aspect, wherein the hollow accommodating space comprises an upper half having a first diameter and a lower half having a second diameter, with the first diameter being smaller than the second diameter; the flexible printed circuit board is fixedly provided on the inner surface of the lower half; and the fixed portion is fixedly provided on the inner surface of the upper half, with the contacting portion and the squeezing portion being accommodated within the lower half.

According to a fourth aspect of the present invention, there is provided a key device as described in the third aspect, wherein the contacting portion is a projection provided towards the flexible printed circuit board.

According to a fifth aspect of the present invention, there is provided a key device as described in the fourth aspect, wherein the hollow accommodating space, the key body, the lateral contacting structure and the flexible printed circuit board are provided coaxially.

According to a sixth aspect of the present invention, there is provided a key device as described in the first aspect, wherein the key body is made of a transparent material.

According to a seventh aspect of the present invention, there is provided an electronic apparatus, comprising a key device, the key device comprising a housing and a key structure, a hollow accommodating space being provided in the housing, and the key structure comprising:

a key body, at least part of the key body being accommodated in the hollow accommodating space;

a lateral contacting structure positioned within the hollow accommodating space and comprising a contacting portion, the contacting portion being provided at the outer side of the key body, and when being pressed, the lateral contacting structure being squeezed by the key body, so that the contacting portion is in contact with a flexible printed circuit board; and a flexible printed circuit board positioned within the hollow accommodating space and provided at the outer side of the contacting portion for sensing the lateral contact of the contacting portion.

According to an eighth aspect of the present invention, there is provided an electronic apparatus as described in the seventh aspect, wherein the lateral contacting structure further comprises a fixed portion and a squeezing portion, with the contacting portion being provided between the fixed portion and the squeezing portion; the fixed portion being fixedly provided on the inner surface of the hollow accommodating space; the contacting portion being spaced apart from the flexible printed circuit board at a certain distance when the key body is in a loosened state, and being in contact with the flexible printed circuit board when the key body is in a pressed state; the squeezing portion supporting the key body when the key body is in a loosened state, and moving towards the flexible printed circuit board under the squeeze of the squeezing portion when the key body is in a pressed state, and directing the contacting portion to be in contact with the flexible printed circuit board.

According to a ninth aspect of the present invention, there is provided an electronic apparatus as described in the eighth aspect, wherein the hollow accommodating space comprises an upper half having a first diameter and a lower half having a second diameter, with the first diameter being smaller than the second diameter; the flexible printed circuit board is fixedly provided on the inner surface of the lower half; and the fixed portion is fixedly provided on the inner surface of the upper half, with the contacting portion and the squeezing portion being accommodated within the lower half.

According to a tenth aspect of the present invention, there is provided an electronic apparatus as described in the ninth aspect, wherein the contacting portion is a projection provided towards the flexible printed circuit board.

According to an eleventh aspect of the present invention, there is provided an electronic apparatus as described in the tenth aspect, wherein the hollow accommodating space, the key body, the lateral contacting structure and the flexible printed circuit board are provided coaxially.

According to a twelfth aspect of the present invention, there is provided an electronic apparatus as described in the seventh aspect, wherein the key body is made of a transparent material.

Since the key body in the key device of the present invention is in lateral contact with the flexible printed circuit board, the effect of the complete transparency of the key may be realized when the key body in the key structure is made of a transparent material.

These and further aspects and features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the appended claims.

Features that are described and/or illustrated with respect to one embodiment may be used in the same way or in a similar way in one or more other embodiments and/or in combination with or instead of the features of the other embodiments.

It should be emphasized that the term "comprises/comprising" when used in this specification is taken to specify the presence of stated features, integers, steps or components but does not preclude the presence or addition of one or more other features, integers, steps, components or groups thereof.

Many aspects of the invention can be better understood with reference to the following drawings. The components in the drawings are not necessarily to scale, emphasis instead being placed upon clearly illustrating the principles of the present invention. To facilitate illustrating and describing some parts of the invention, corresponding portions of the drawings may be exaggerated in size, e.g., made larger in relation to other parts than in an exemplary device actually made according to the invention. Elements and features depicted in one drawing or embodiment of the invention may be combined with elements and features depicted in one or more additional drawings or embodiments. Moreover, in the drawings, like reference numerals designate corresponding parts throughout the several views and may be used to designate like or similar parts in more than one embodiment.

BRIEF DESCRIPTION OF THE DRAWINGS

The drawings are included to provide further understanding of the present invention, which constitute a part of the specification and illustrate the preferred embodiments of the present invention, and are used for setting forth the principles of the present invention together with the description. The same element is represented with the same reference number throughout the drawings. In the drawings:

FIG. 3 (*b*) illustrates an exploded view of the key structure according to the embodiment shown in FIG. 2;

DETAILED DESCRIPTION OF THE INVENTION

The interchangeable terms "electronic apparatus" and "electronic device" include portable radio communication apparatus. The term "portable radio communication apparatus", which hereinafter is referred to as a "mobile terminal", "portable electronic device", or "portable communication device", comprises all apparatuses such as mobile telephones, pagers, communicators, electronic organizers, personal digital assistants (PDAs), smartphones, portable communication devices or the like.

In the present application, embodiments of the invention are described primarily in the context of a portable electronic device in the form of a mobile telephone (also referred to as "mobile phone"). However, it shall be appreciated that the invention is not limited to the context of a mobile telephone and may relate to any type of appropriate electronic apparatus having the function of photographing and sound recording.

The preferred embodiments of the present invention are described as follows in reference to the drawings.

Figure 1:
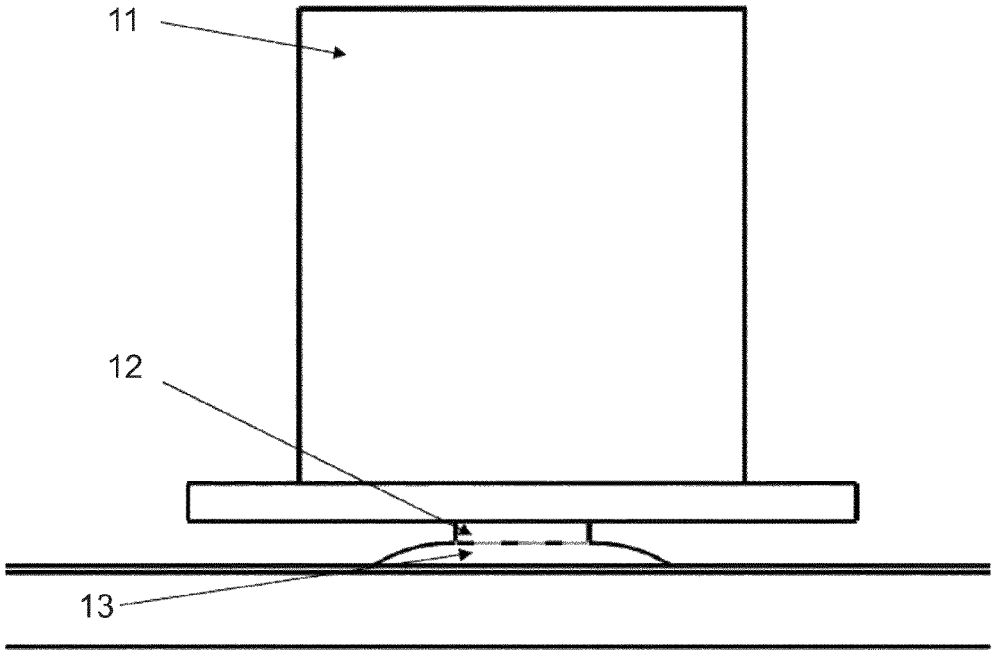
FIG. 1 illustrates the key structure of a typical electronic apparatus.
Figure 2:
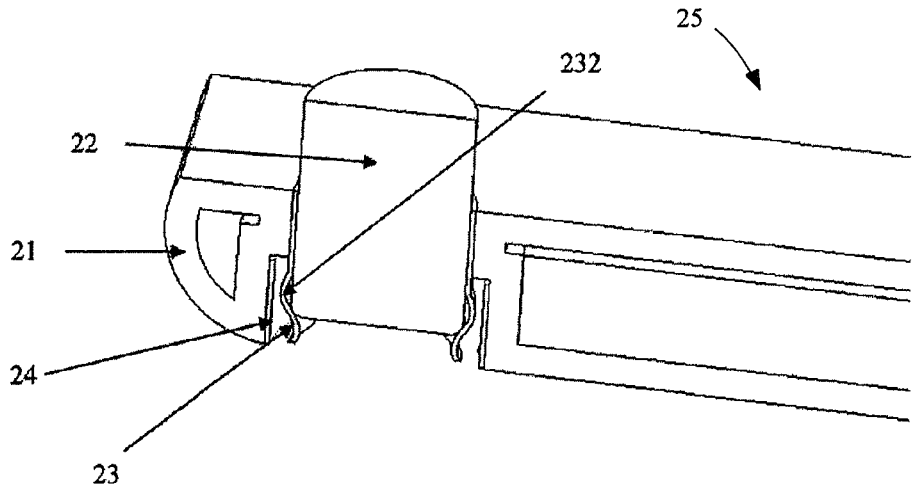
FIG. 2 illustrates a sectional view of the key structure according to an embodiment of the present invention.

FIG. 2 illustrates a sectional view of the key device according to an embodiment of the present invention. As shown in FIG. 2, the key device comprises a housing 21 and a key structure. Here, for the sake of convenience, a key structure is taken as an example in description, although actually the electronic apparatus 25 may comprise a key matrix consisting of a plurality of such key structures.

As shown in FIG. 2, the housing 21 is provided with a hollow accommodating space, and the key structure comprises a key body 22, a lateral contacting structure 23 and a flexible printed circuit board 24.

At least part of the key body 22 is accommodated in the hollow accommodating space of the housing 21.

The lateral contacting structure 23 is positioned within the hollow accommodating space of the housing 21 and comprises a contacting portion 232, the contacting portion 232 being provided at the outer side of the key body 22. When the key body 22 is pressed, the lateral contacting structure 23 is squeezed by the key body 22, so that the contacting portion 232 is in contact with the flexible printed circuit board 24, The flexible printed circuit board 24 is positioned within the hollow accommodating space of the housing 21 and provided at the outer side of the contacting portion 232 for sensing the lateral contact of the contacting portion 232.

With the above key structure, the key device provided in this embodiment may feed the key information of the key body back to the electronic apparatus provided with the key device, for example, provide the key information to the host controller of the electronic apparatus 25, so that the host controller of the electronic apparatus performs corresponding processing according to such key information. The manner in which the key body 22 and the flexible printed circuit board 24 make contact with each other in the key structure is lateral contact, instead of conventional bottom contact. When the top of the key body 22 is pressed, the contacting portion 232 at the lateral side of the key body is in contact with the flexible printed circuit board 24. Thus, the flexible printed circuit board may sense the contacting action, thereby providing the key information of the key body.

A plurality of such key structures are provided in a plurality of hollow accommodating spaces of the housing 21 of the key device, forming a key matrix of the electronic apparatus 25. When the key body 22 is made of a transparent material, since the flexible printed circuit board 24 is provided at the outer side of the key body 22, the flexible printed circuit board does not block the light entering from the bottom of the key, thereby realizing the complete transparency of the key of the electronic apparatus.

The key structure shown in FIG. 2 will be further described as follows with reference to exploded views.

Figure 3:
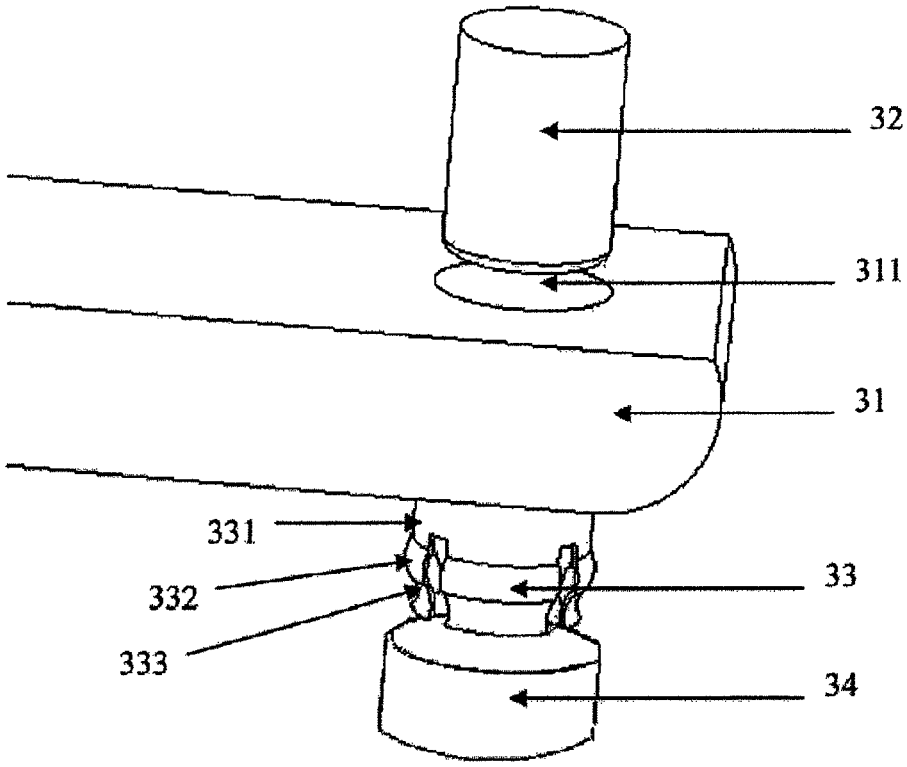
FIG. 3 (*a*) illustrates a sectional view of an exploded view of the key structure according to the embodiment shown in FIG. 2.
Figure 3:
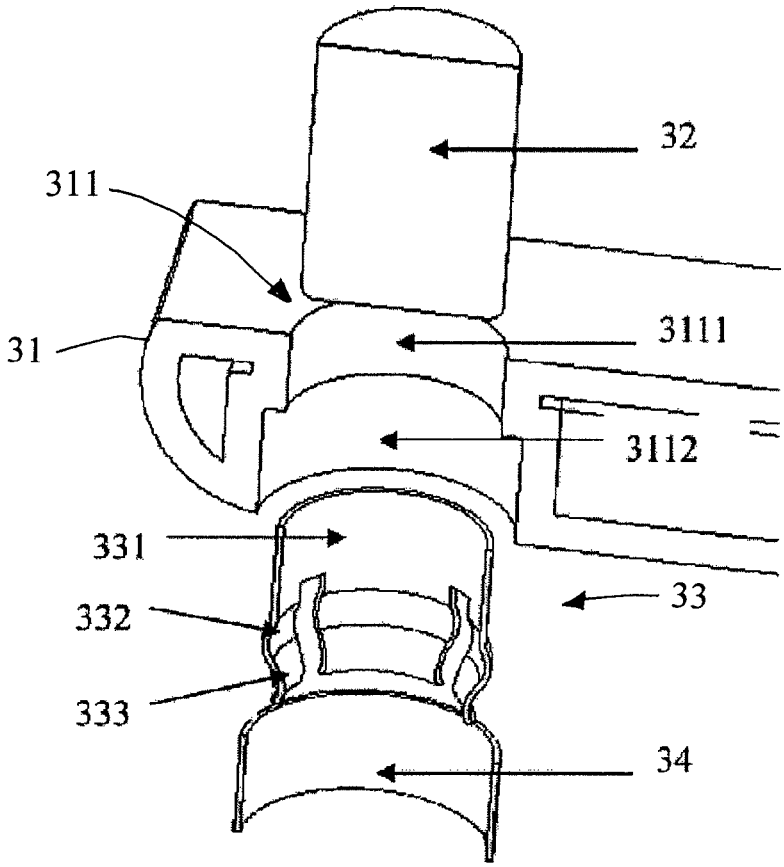

FIG. 3 (*a*) illustrates an exploded view of the key device according to the embodiment shown in FIG. 2, and FIG. 3 (*b*) illustrates a sectional view of an exploded view of the key device according to the embodiment shown in FIG. 2. In the embodiments shown FIGS. 3 (*a*) and 3 (*b*), the key device comprising one key structure is taken as an example. In practice, the electronic apparatus 25 (FIG. 2) may be provided with a plurality of key structures of the present invention, and these embodiments are not limited thereto.

As shown in FIG. 3 (*a*), the key device of this embodiment comprises a housing 21 and a key structure. The housing 21 is provided with a hollow accommodating space 311. The key structure comprises a key body 22, a lateral contacting structure 23 and a flexible printed circuit board 24.

The lateral contacting structure comprises a fixed portion 331, a contacting portion 332 and a squeezing portion 333, with the contacting portion 232 being provided between the fixed portion 331 and the squeezing portion 333.

The fixed portion 331 is fixedly provided on the inner surface of the hollow accommodating space 311.

The contacting portion 232 is spaced apart from the flexible printed circuit board 24 at a certain distance when the key body 22 is in a loosened state, e.g., is unpressed, and is in contact with the flexible printed circuit board 24 when the key body 22 is in a pressed state.

The squeezing portion 333 supports the key body 22 when the key body 22 is in a loosened state. The squeezing portion 333 is moved towards the flexible printed circuit board 24 under the squeezing force applied by the key body 22 when the key body 22 is in a pressed state and directs the contacting portion 332 to be in contact with the flexible printed circuit board 24.

The lateral contacting structure 23 may be an elastic wall, with a projection of which facing the key body 22 being the squeezing portion as described above, and a projection of which facing the flexible printed circuit board 24 being the contacting portion 232 as described above.

In the example shown in FIG. 3 (*a*), the lateral contacting structure 23 and the flexible printed circuit board 24 may be provided in the manner shown in FIG. 3 (*b*); however, this embodiment is not limited thereto.

As shown in FIG. 3 (*b*), the hollow accommodating space 311 of the housing 21 of the key device comprises an upper half 3111 having a first diameter and a lower half 3112 having a second diameter, with the first diameter being smaller than the second diameter. The flexible printed circuit board 24 is fixedly provided on the inner surface of the lower half 3112. The fixed portion 331 of the lateral contacting portion 23 is fixedly provided on the inner surface of the upper half 3111. The contacting portion 232 and the squeezing portion 333 of the lateral contacting portion 23 are accommodated within the lower half 3112.

The manner in which the flexible printed circuit board 24 is fixedly provided on the inner surface of the lower half 3112 and the fixed portion 331 of the lateral contacting structure 23 is fixedly provided on the inner surface of the upper half 3111 may be sticking by using a glue layer, or may be by other existing methods, and this embodiment is not limited thereto.

It can be seen from the exploded views of FIGS. 3 (*a*) and 3 (*b*) that there is no flexible printed circuit board 24 provided at the bottom of the key body 22, and the flexible printed circuit board 24 provides the key information of the key body 22 through the lateral contact of the contacting portion 332 of the lateral contacting structure 23. When the key body 22 is made of a transparent material, the flexible printed circuit board 24 will not block incidence of light from the bottom of the key body 22, thereby realizing the complete transparency of the key.

The key device shown in FIG. 2 will be further described as follows with reference to a schematic diagram showing the operational state of the key structure.

Figure 4:
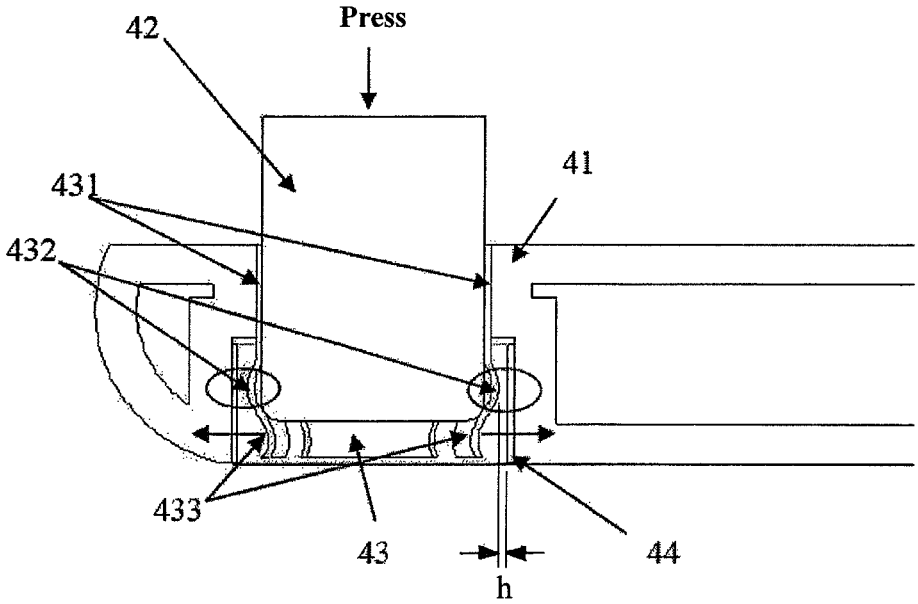
FIG. 4 illustrates a schematic diagram showing the key structure according to the embodiment shown in FIG. 2 in an operational state.

FIG. 4 illustrates a schematic diagram showing the key structure according to the embodiment shown in FIG. 2 in an operational state.

As shown in FIG. 4, the key device of this embodiment comprises a housing 21 and a key structure. The key structure comprises a key body 22, a lateral contacting structure 23 and a flexible printed circuit board 24. The lateral contacting structure 23 comprises a fixed portion 331, a contacting portion 232 and a squeezing portion 333. The structures of and positional relations between the components of the key device are the same as described in above embodiments, which shall not be described any further.

When the key body 22 is in a loosened state, as shown in FIG. 4, the contacting portion 232 of the lateral contacting structure 23 is spaced apart from the flexible printed circuit board 24 at a distance h. And when the key body 42 is in a pressed state, i.e. when the top of the key body 22 is pressed by a user, the key body 22 generates a force on the squeezing portion 333 of the lateral contacting structure 23, and the squeezing portion 333 moves towards the flexible printed circuit board 44 under the squeeze of the key body 22, thereby bringing or directing the contacting portion 232 to be in contact with the flexible printed circuit board 24. Thus, the flexible printed circuit board 24 may sense the state of the key body 22 under squeeze, thereby providing the key information of the key body 22. When the key body 22 is released by the user, the squeezing portion 333 is also released, the contacting portion 232 is out of contact with the flexible printed circuit board 24, and the flexible printed circuit board 24 may sense that the key 41 is released. At this time, the key body 22 is in a loosened state, and the distance h again exists between the contacting structure 23 and the flexible printed circuit board 24.

It can be seen from the schematic diagram of FIG. 4 showing an operational state that when the key body is in lateral contact with the flexible printed circuit board, the state of the key may also be determined. And since there is no flexible printed circuit board provided at the bottom of the key body, the effect of the complete transparency of the key may be realized when the key body is made of a transparent material.

The key structure shown in FIG. 2 will be further described as follows with reference to a schematic diagram showing the effect of transparency.

Figure 5:
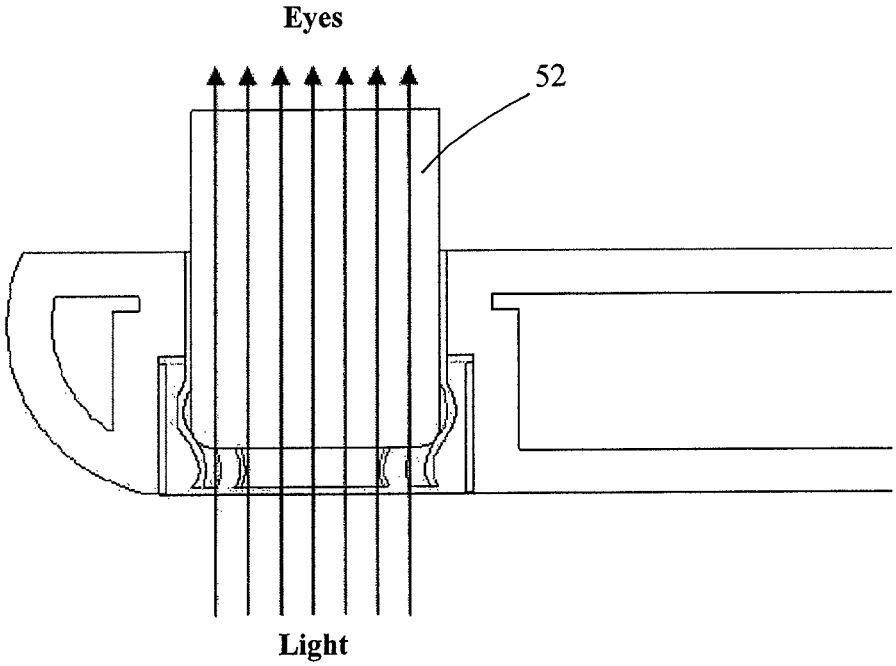
FIG. 5 illustrates a schematic diagram showing an effect of transparency of the key structure according to the embodiment shown in FIG. 2.

FIG. 5 illustrates a schematic diagram showing an effect of transparency of the key structure according to the embodiment shown in FIG. 2.

As shown in FIG. 5, according to the key structure shown in FIG. 2, since there is no flexible printed circuit board provided at the bottom of the key body, the light may pass through the bottom of the key body and providing for viewing of the light from the top of the key, the key being completely transparent, thereby realizing the complete transparency of the key.

In the above embodiment, the key body 52 (also designated 22, 32 and 42 in other drawing figures) is shown as a circular cross-sectional cylinder shape as an example; however, the present invention is not limited thereto. In practice, the key body 52\may be of any shape as actually required. For example, the key body 52 may be a cylinder if elliptical, polygonal, trapezoidal or other cross-sectional shape, etc.

In the above embodiment, the contacting portion of the lateral contacting structure is a projection provided towards the flexible printed circuit board, and the projection may be one, or two that are arranged symmetrically, and may be arranged around the periphery of the key body; however, this embodiment is not limited thereto.

In the above embodiment, the hollow accommodating space of the housing of the key device, the key body of the key structure, the lateral contacting structure and the flexible printed circuit board may be provided coaxially; however, this embodiment is not limited thereto. For example, the flexible printed circuit board may be provided at a position corresponding to the contacting portion of the lateral contacting structure.

An embodiment of the key device of the present invention is described above with reference to FIGS. 2, 3 (*a*), 3 (*b*), 4 and 5. However, this embodiment is not limited to the above mode of implementation. In practice, other key structures may also be used, as long as the key body in the key structure is in lateral contact with the flexible printed circuit board, which are covered by the protection scope of the present invention.

According to another embodiment of the present invention, there is provided an electronic apparatus. The electronic apparatus comprises a key device, the key device comprising a housing and a key structure. A hollow accommodating space is provided in the housing.

In this embodiment, the key structure comprises a key body, a lateral contacting structure and a flexible printed circuit board, wherein at least part of the key body is accommodated in the hollow accommodating space;

the lateral contacting structure is positioned within the hollow accommodating space of the housing and comprises a contacting portion, the contacting portion being provided at the outer side of the key body, and when being pressed, the lateral contacting structure being squeezed by the key body, so that the contacting portion is in contact with the flexible printed circuit board; and the flexible printed circuit board is positioned within the hollow accommodating space of the housing and provided at the outer side of the contacting portion for sensing the lateral contact of the contacting portion.

In one embodiment, the lateral contacting portion further comprises a fixed portion and a squeezing portion, with the contacting portion being provided between the fixed portion and the squeezing portion; the fixed portion is fixedly provided on the inner surface of the hollow accommodating space; the contacting portion is spaced apart from the flexible printed circuit board at a certain distance when the key body is in a loosened state, and is in contact with the flexible printed circuit board when the key body is in a pressed state; the squeezing portion supports the key body when the key body is in a loosened state, and moves towards the flexible printed circuit board under the squeeze of the squeezing portion when the key body is in a pressed state, and directs the contacting portion to be in contact with the flexible printed circuit board.

In another embodiment, the hollow accommodating space comprises an upper half having a first diameter and a lower half having a second diameter, with the first diameter being smaller than the second diameter; the flexible printed circuit board is fixedly provided on the inner surface of the lower half; and the fixed portion is fixedly provided on the inner surface of the upper half, with the contacting portion and the squeezing portion being accommodated within the lower half.

In the above embodiment, the contacting portion may be a projection provided towards the flexible printed circuit board.

In the above embodiment, the squeezing portion may be a projection provided towards the key body.

In the above embodiment, the hollow accommodating space, the key body, the lateral contacting structure and the flexible printed circuit board may be provided coaxially.

In the above embodiment, the key body may be made of a transparent material.

In this embodiment, the key device of the electronic apparatus may be implemented by using the key device shown in FIG. 2. The contents of the key device shown in FIGS. 2-5 are incorporated herein, which shall not be described any further.

Being provided with the key device of the present invention, the electronic apparatus of the present invention may realize the effect of complete transparency of the key.

The preferred embodiments of the present invention are described above with reference to the drawings. The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

What is claimed:

1. A key device, comprising a housing and a key structure, a hollow accommodating space in the housing, and the key structure comprising:

a key body, at least part of the key body being in the hollow accommodating space, the key body having a proximal end that a user presses against to actuate the key and a distal end in the hollow accommodating space, a longitudinal axis extending between the proximal and distal ends; and a lateral contacting structure positioned within the hollow accommodating space and comprising a flexible member having a contacting portion and a squeezing portion, the contacting portion being at an outer side of the distal end of the key body, and when the key body is pressed, the distal portion of the key body moves along the longitudinal axis and against the squeezing portion to squeeze the squeezing portion in a radially outward direction and force the contacting portion into contact with a sensing element retained in the hollow accommodating space, wherein:

the squeezing portion is a sole actor against the key body when the key body is unpressed to urge the key body along the longitudinal axis and support the key body in a loosened position where the contacting portion is spaced apart from the sensing element.

2. The key device according to claim 1, wherein:

the lateral contacting structure further comprises a fixed portion, the contacting portion being between the fixed portion and the squeezing portion;

the fixed portion is fixedly provided on the inner surface of the hollow accommodating space; and the contacting portion is spaced apart from the sensing element at a certain distance when the key body is in a loosened state, and is in contact with the sensing element when the key body is in a pressed state.

3. The key device according to claim 2, wherein the hollow accommodating space comprises an upper half having a first diameter and a lower half having a second diameter, the first diameter being smaller than the second diameter; the sensing element fixedly provided on the inner surface of the lower half; and the fixed portion is fixed on the inner surface of the upper half, with the contacting portion and the squeezing portion being accommodated within the lower half.

4. The key device according to claim 3, wherein the contacting portion is a projection provided towards the sensing element.

5. The key device according to claim 4, wherein the hollow accommodating space, the key body, the lateral contacting structure and the sensing element are coaxial.

6. The key device according to claim 1, wherein the key body is made of a transparent material.

7. The image retrieval method of claim 1, wherein the sensing element is a flexible printed circuit board.

8. An electronic apparatus, comprising a key device, the key device comprising a housing and a key structure, a hollow accommodating space in the housing, and the key structure comprising:

a key body, at least part of the key body in the hollow accommodating space, the key body having a proximal end that a user presses against to actuate the key and a distal end in the hollow accommodating space, a longitudinal axis extending between the proximal and distal ends; and a lateral contacting structure positioned within the hollow accommodating space and comprising a flexible member having a contacting portion and a squeezing portion, the contacting portion at an outer side of the distal end of the key body, and when the key body is pressed, the distal portion of the key body moves along the longitudinal axis and against the squeezing portion to squeeze the squeezing portion in a radially outward direction and force the contacting portion into contact with a sensing element retained in the hollow accommodating space, wherein:

the squeezing portion is a sole actor against the key body when the key body is unpressed to urge the key body along the longitudinal axis and support the key body in a loosened position where the contacting portion is spaced apart from the sensing element.

9. The electronic apparatus according to claim 8, wherein:

the lateral contacting structure further comprises a fixed portion, with the contacting portion between the fixed portion and the squeezing portion;

the fixed portion is fixedly provided on the inner surface of the hollow accommodating space; and the contacting portion is spaced apart from the sensing element at a certain distance when the key body is in a loosened state, and is in contact with the sensing element when the key body is in a pressed state.

10. The electronic apparatus according to claim 9, wherein the hollow accommodating space comprises an upper half having a first diameter and a lower half having a second diameter, with the first diameter being smaller than the second diameter; the sensing element is fixedly provided on the inner surface of the lower half; and the fixed portion is fixedly provided on the inner surface of the upper half, with the contacting portion and the squeezing portion being accommodated within the lower half.

11. The electronic apparatus according to claim 10, wherein the contacting portion is a projection provided towards the sensing element.

12. The electronic apparatus according to claim 11, wherein the hollow accommodating space, the key body, the lateral contacting structure and the sensing element are coaxial.

13. The electronic apparatus according to claim 8, wherein the key body is made of a transparent material.

14. The electronic apparatus of claim 7, wherein the sensing element is a flexible printed circuit board.

15. A key device, comprising a housing and a key structure, a hollow accommodating space in the housing, and the key structure comprising:

a key body, at least part of the key body being in the hollow accommodating space;

a lateral contacting structure positioned within the hollow accommodating space and comprising a contacting portion, the contacting portion being at an outer side of the key body, and when being pressed, the lateral contacting structure being squeezed by the key body, so that the contacting portion is in contact with a flexible printed circuit board; and the flexible printed circuit board positioned within the hollow accommodating space and provided at an outer side of the contacting portion for sensing the lateral contact of the contacting portion;

wherein the hollow accommodating space, the key body, the lateral contacting structure and the flexible printed circuit board are coaxial.

* * * * *